US012072095B2

(12) United States Patent
Hamilton

(10) Patent No.: US 12,072,095 B2
(45) Date of Patent: Aug. 27, 2024

(54) CANDLE MAINTENANCE TOOL ASSEMBLY

(71) Applicant: Angela Hamilton, Centerville, OH (US)

(72) Inventor: Angela Hamilton, Centerville, OH (US)

( * ) Notice: Subject to any disclaimer, the term of this patent is extended or adjusted under 35 U.S.C. 154(b) by 394 days.

(21) Appl. No.: 17/537,875

(22) Filed: Nov. 30, 2021

(65) Prior Publication Data

US 2023/0167973 A1 Jun. 1, 2023

(51) Int. Cl.

| | |
|---|---|
| ***F23D 3/36*** | (2006.01) |
| ***F23D 3/16*** | (2006.01) |
| ***F23Q 2/167*** | (2006.01) |
| ***F23Q 2/173*** | (2006.01) |
| ***F23Q 2/32*** | (2006.01) |

(52) U.S. Cl.
CPC ..... *F23D 3/36* (2013.01); *F23D 3/16* (2013.01); *F23Q 2/167* (2013.01); *F23Q 2/173* (2013.01); *F23Q 2/32* (2013.01)

(58) Field of Classification Search
CPC ..... F23D 3/26; F23D 3/16; F23Q 2/32; F23Q 2/167; F23Q 2/173
USPC ..... 431/120, 129–141
See application file for complete search history.

(56) References Cited

U.S. PATENT DOCUMENTS

| | | | | |
|---|---|---|---|---|
| 5,345,952 | A * | 9/1994 | Nielander | A24F 19/14 30/113 |
| 5,738,117 | A | 4/1998 | Fontaine, Jr. | |
| 5,865,614 | A * | 2/1999 | Hsu | F23Q 2/287 431/255 |
| 6,619,950 | B2 | 9/2003 | Ricci | |
| 6,875,013 | B2 | 4/2005 | Smith | |
| 7,497,684 | B1 | 3/2009 | Storms | |
| 8,490,784 | B2 * | 7/2013 | Cortesi | A24F 19/14 206/136 |
| 9,681,686 | B2 | 6/2017 | Mikano | |
| 2003/0062055 | A1 | 4/2003 | Park | |
| 2018/0360108 | A1 | 12/2018 | King, Jr. | |

* cited by examiner

*Primary Examiner* — Vivek K Shirsat

(57) ABSTRACT

A candle maintenance tool assembly for trimming and cutting a wick of a candle includes a lighter that has a handle and an elongated ignition tube extending away from the handle. The elongated ignition tube can be extended into a candle. The elongated ignition tube produces a flame when the lighter is actuated to ignite a wick of the candle. A cutting unit is movably integrated into the handle and the cutting unit is actuatable into a cutting condition to cut the wick of the candle to a desired length.

6 Claims, 5 Drawing Sheets

CANDLE MAINTENANCE TOOL ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR NOT APPLICABLE

BACKGROUND OF THE INVENTION

(1) Field of the Invention

The disclosure relates to candle devices and more particularly pertains to a new candle device for trimming a wick of a candle and igniting the wick of the candle. The device includes a lighter with an elongated ignition tube for enhancing lighting a wick of a candle. The device includes a wick trimmer that is integrated into the lighter for trimming with wick of the candle to an optimum length. In this way the lighter can trim the length of the wick and ignite the wick.

(2) Description of Related Art Including Information Disclosed Under 37 CFR 1.97 and 1.98

The prior art relates to candle devices including a lighter that has a cigar cutter integrated into the lighter for cutting a cigar and lighting the cigar. The prior art discloses a variety of lighter devices that includes a wick cutter that is positioned within an ignition tube of the lighter for contemporaneously cutting and lighting a wick of a candle. The prior art discloses a lighter with a cigarette cutter and a storage tube for storing a partially smoked cigarette. The prior art discloses a lighter with a pair of scissors integrated into the lighter.

BRIEF SUMMARY OF THE INVENTION

An embodiment of the disclosure meets the needs presented above by generally comprising a lighter that has a handle and an elongated ignition tube extending away from the handle. The elongated ignition tube can be extended into a candle. The elongated ignition tube produces a flame when the lighter is actuated to ignite a wick of the candle. A cutting unit is movably integrated into the handle and the cutting unit is actuatable into a cutting condition to cut the wick of the candle to a desired length.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
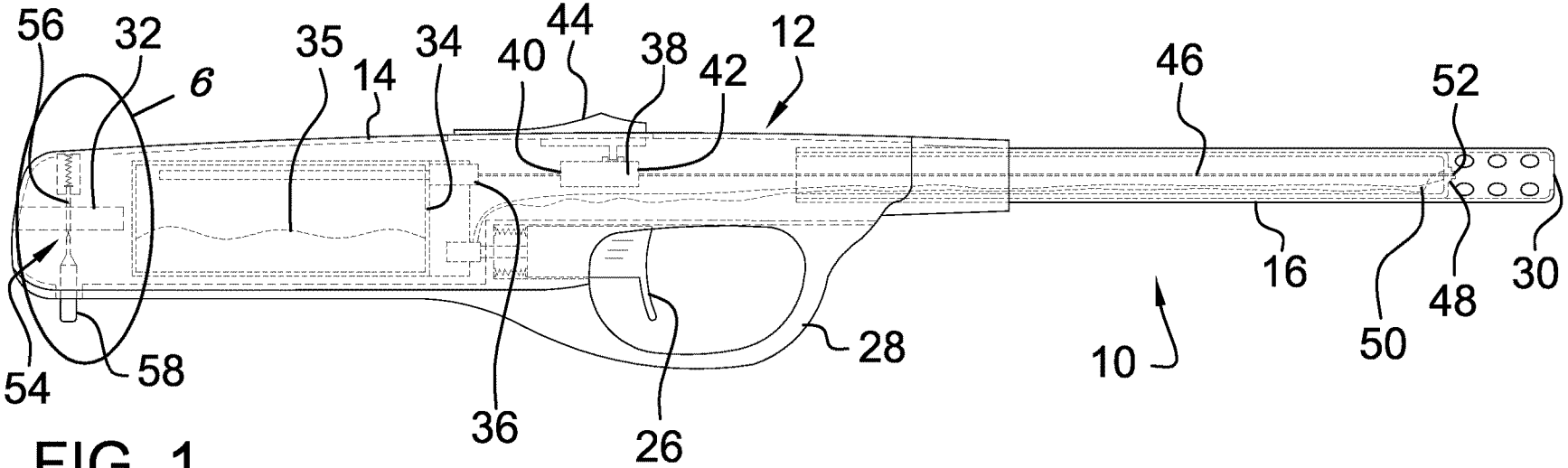
FIG. 1 is a left side phantom view of a candle maintenance tool assembly according to an embodiment of the disclosure.
Figure 2:
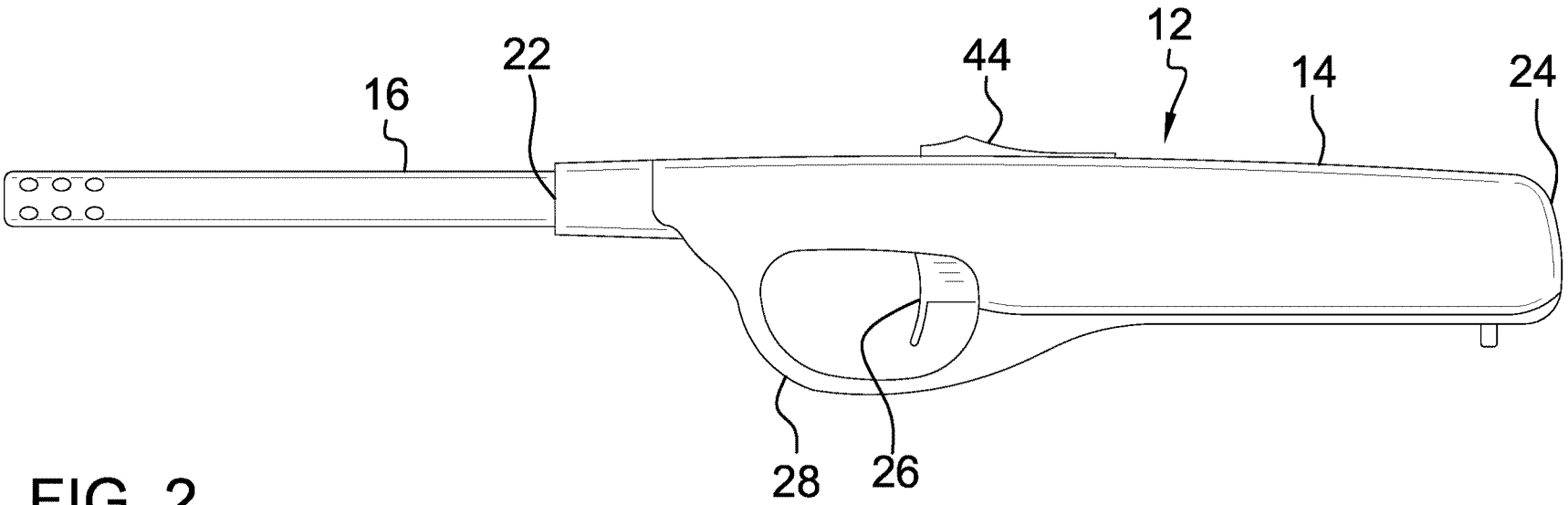
FIG. 2 is a left side view of an embodiment of the disclosure.
Figure 4:
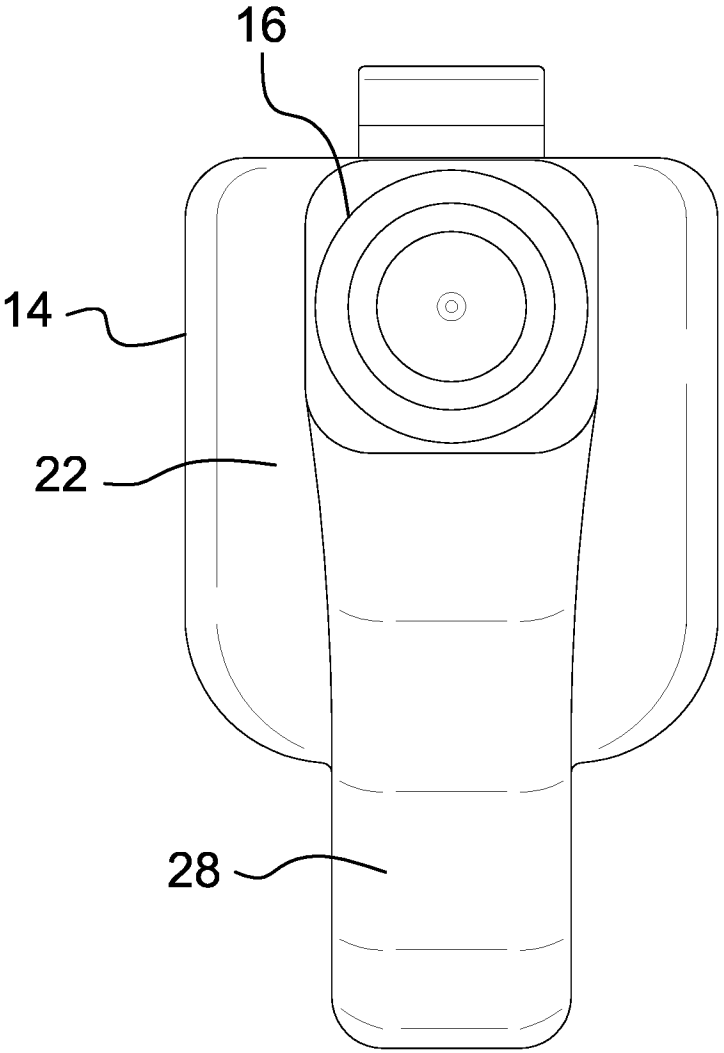
FIG. 4 is a front view of an embodiment of the disclosure.
Figure 3:
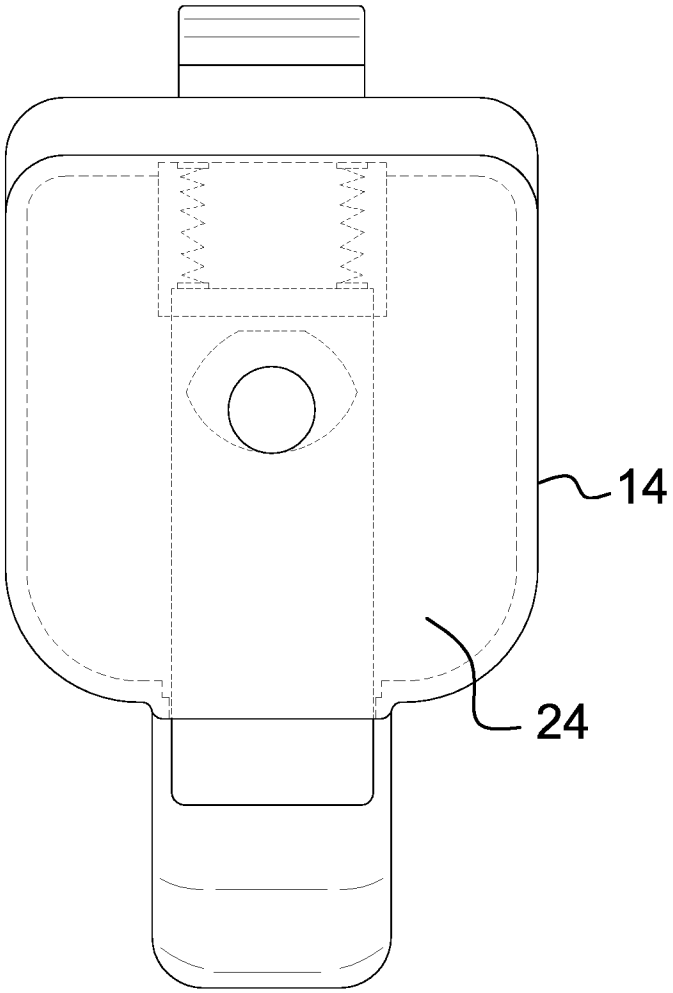
FIG. 3 is a back view of an embodiment of the disclosure.
Figure 5:
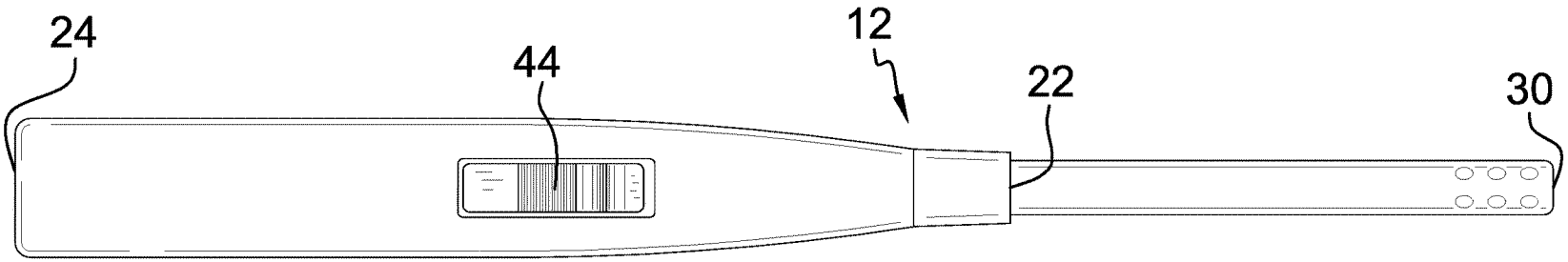
FIG. 5 is a top view of an embodiment of the disclosure.
Figure 6:
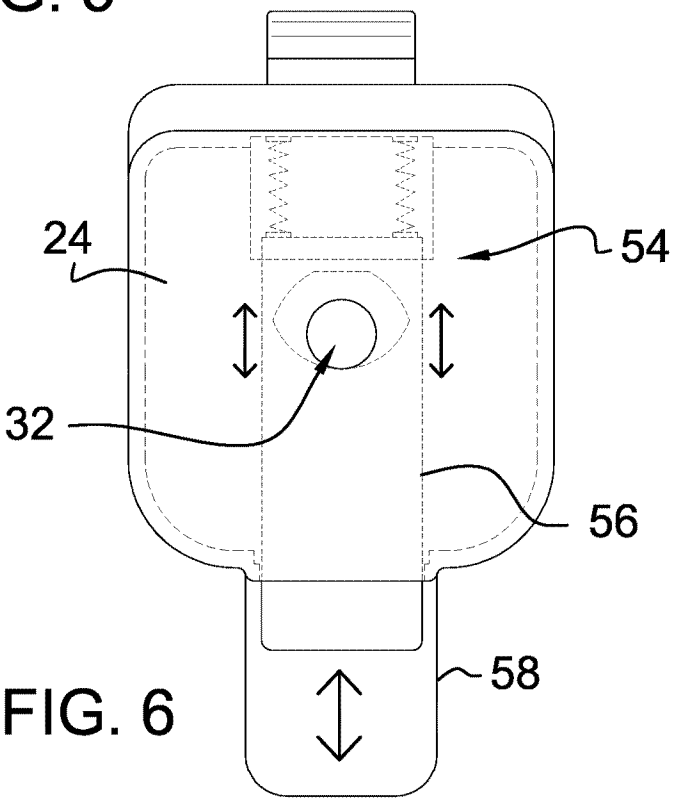
FIG. 6 is a detail view taken from circle 6 of FIG. 1 of an embodiment of the disclosure showing a cutting unit in a retracted position.
Figure 7:
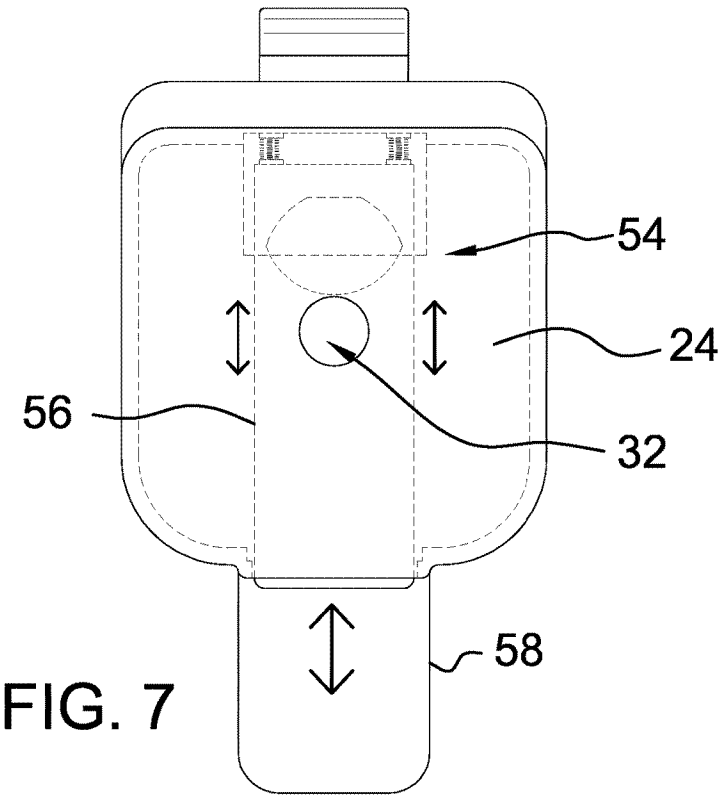
FIG. 7 is a detail view taken from circle 6 of FIG. 1 of an embodiment of the disclosure showing a cutting unit in a cutting position.
Figure 8:
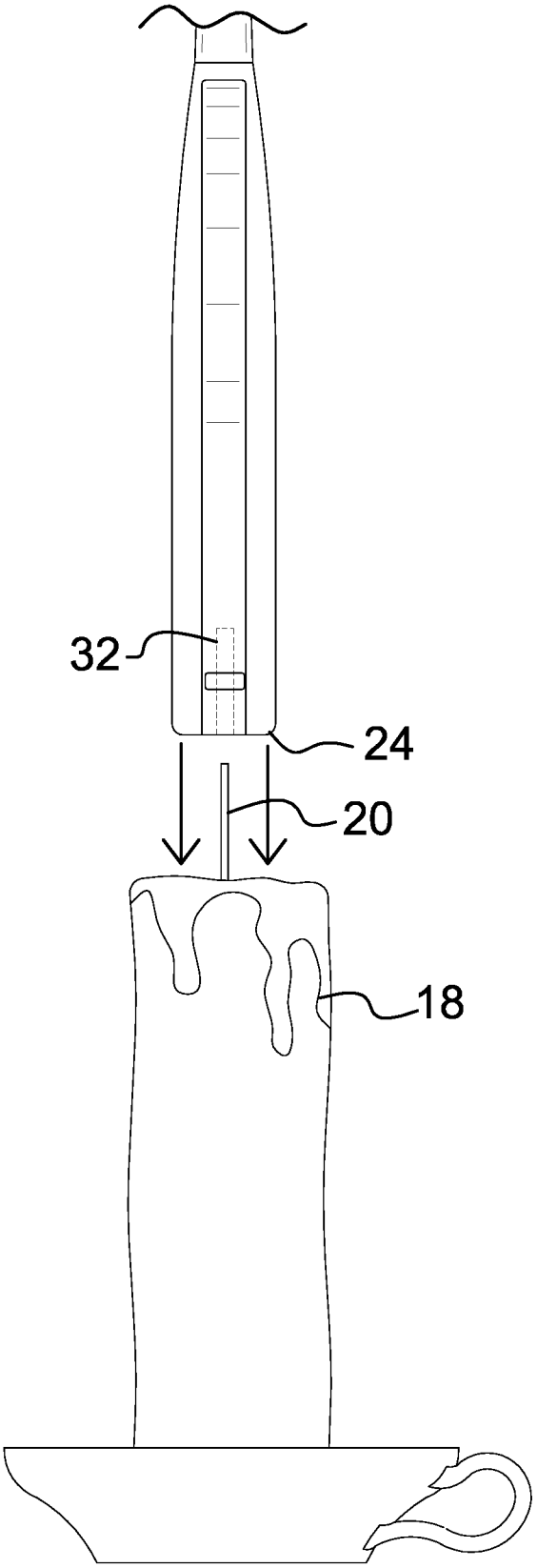
FIG. 8 is a perspective in-use view of an embodiment of the disclosure showing a wick being inserted into a well in a handle of a lighter.
Figure 9:
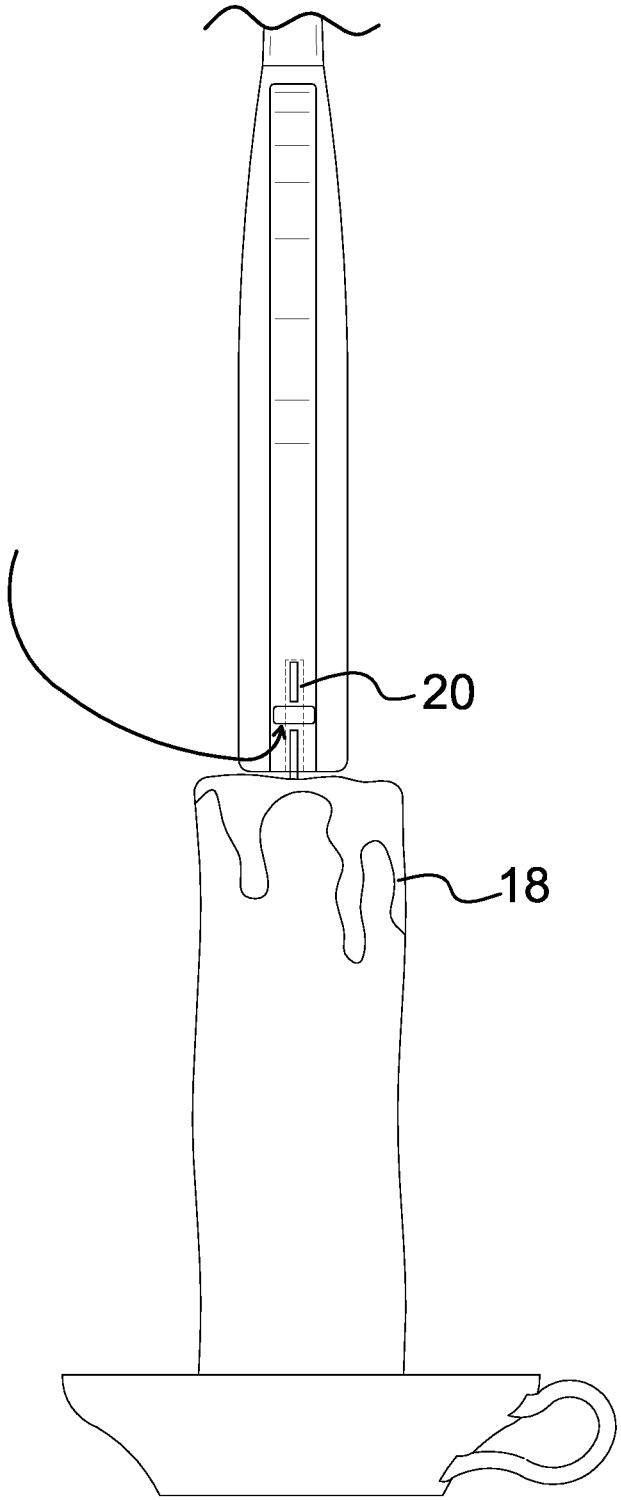
FIG. 9 is a perspective in-use view of an embodiment of the disclosure showing a wick being positioned within a well in a handle of a lighter.

With reference now to the drawings, and in particular to FIGS. 1 through 9 thereof, a new candle device embodying the principles and concepts of an embodiment of the disclosure and generally designated by the reference numeral 10 will be described.

As best illustrated in FIGS. 1 through 9, the candle maintenance tool assembly 10 generally comprises a lighter 12 that has a handle 14 and an elongated ignition tube 16 extending away from the handle 14. The length of the elongated ignition tube 16 facilitates the elongated ignition tube 16 to be extended into a candle 18. The candle 18 may be a wax candle of any conventional size or design. The elongated ignition tube 16 produces a flame when the lighter 12 is actuated to ignite a wick 20 of a candle 18. The handle 14 has a front end 22 and a back end 24, and the handle 14 is elongated between the front end 22 and the back end 24. A trigger 26 is movably integrated into the handle 14 thereby facilitating the trigger 26 to be manipulated. The handle 14 may include a trigger guard 28 that is integrated into the handle 14 and the trigger guard 28 may surround the trigger 26.

The elongated ignition tube 16 has a distal end 30 with respect to the front end 22 of the handle 14 and the distal end 30 is open. The back end 24 of the handle 14 has a well 32 extending toward the front end 22 to insertably receive the wick 20 of the candle 18. A fuel reservoir 34 is positioned within the handle 14 which contains a combustible fuel 35 and the fuel reservoir 34 has an outlet 36. A valve 38 is positioned within the handle 14 and the valve 38 has an inlet 40 and an exhaust 42. The inlet 40 is fluidly coupled to the outlet 36 of the fuel reservoir 34 to receive the combustible fuel 35 from the fuel reservoir 34. The valve 38 is adjustable between a minimum flow rate and a maximum flow rate thereby facilitating the valve 38 to release the combustible fuel 35 between a minimum rate and a maximum rate. The valve 38 may comprise a gas valve of any conventional design that has an adjustable flow rate and the valve 38 is in communication with the trigger 26 such that the valve 38 is opened when the trigger 26 is depressed and the valve 38 is closed when the trigger 26 is released.

A switch 44 is slidably integrated into the handle 14 and the switch 44 is mechanically coupled to the valve 38. The switch 44 actuates the valve 38 between the minimum flow rate and the maximum flow rate to adjust the release of the combustible fuel 35 between the minimum rate and the maximum rate. A fuel conduit 46 is positioned in the elongated tube 16 and the fuel conduit 46 extends between the exhaust 42 of the valve 38 and the distal end 30 of the elongated tube 16. The fuel conduit 46 is fluidly coupled to the exhaust 42 of the valve 38 to direct the combustible fuel 35 to the distal end 30 of the elongated tube 16. An ignitor 48 is integrated into the handle 14 and the ignitor 48 is in communication with the trigger 26. Furthermore, the ignitor 48 is actuated when the trigger 26 is depressed and the ignitor 48 produces an electrical current when the ignitor 48 is actuated.

A conductor 50 is electrically coupled to the ignitor 48 and the conductor 50 extends to the distal end 30 of the elongated tube 16. The conductor 50 has a contact 52 that is electrically coupled to the conductor 50 to produce a spark when the ignitor 48 is actuated. The contact 52 is disposed in the distal end 30 of the elongated tube 16 to ignite the combustible fuel 35. The ignitor 48 may be a piezoelectric ignitor or the like and the contact 52 may be a static discharge contact 52 that produces a spark that has a sufficiently high temperature to ignite the combustible fuel 35.

A cutting unit 54 is provided and the cutting unit 54 is movably integrated into the handle 14. The cutting unit 54 is actuatable into a cutting condition to cut the wick 20 of the candle 18 to a desired length. The cutting unit 54 comprises a cutter 56 that is movably integrated into the handle 14. The cutter 56 extends laterally across the well 32 in the back end 24 of the handle 14 when the cutter 56 is urged into a cutting thereby cutting the wick 20 when the wick 20 is inserted into the well 32. Conversely, the cutter 56 is biased into a retracted position having the cutter 56 being displaced from the well 32. The cutting unit 54 includes a button 58 that is movably integrated into the handle 14 and the button 58 is positioned proximate the well 32. The button 58 is in mechanical communication with the cutter 56 and the cutter 56 is urged into the cutting position when the button 58 is depressed. The cutter 56 may include a blade for cutting the wick 20 and a spring biasing member which biases the blade to be displaced from the well 32.

In use, the wick 20 can be inserted into the well 32 and the button 58 is depressed to trim the wick 20 to an optimum length for burning the candle 18. The trigger 26 is depressed to open the valve 38 and to ignite the combustible fuel 35 to produce a flame at the distal end 30 of the elongated tube 16 and the distal end 30 of the elongated tube 16 is directed toward the wick 20 to ignite the wick 20. In this way the wick 20 can be trimmed to the optimum length and the wick 20 can be ignited with a single device, rather than having to employ two separate devices to trim the wick 20 and to ignite the wick 20.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A candle maintenance tool assembly for trimming a wick of a candle and lighting the wick of the candle, said assembly comprising:

a lighter having a handle and an elongated ignition tube extending away from said handle wherein said elongated ignition tube is configured to be extended into a candle, said elongated ignition tube producing a flame when said lighter is actuated wherein said lighter is configured to ignite a wick of the candle;

a cutting unit being movably integrated into said handle, said cutting unit being actuatable into a cutting condition wherein said cutting unit is configured to cut the wick of the candle to a desired length;

wherein said handle has a front end and a back end, said handle being elongated between said front end and said back end, said handle having a trigger being movably integrated into said handle wherein said trigger is configured to be manipulated, said elongated ignition tube having a distal end with respect to said handle, said distal end being open, said back end of said handle having a well extending toward said front end wherein said back end is configured to insertably receive the wick of the candle into said well; and wherein said cutting unit comprises a cutter being movably integrated into said handle, said cutter being positioned within said well inset from said back end of said handle such that said cutter is configured for cutting the wick when the wick is positioned to extend within said well, said cutter extending through said well in said back end of said handle when said cutter is urged into a cutting position, said cutter being biased into a retracted position having said cutter being displaced from said well.

2. The assembly according to claim 1, further comprising:

a fuel reservoir being positioned within said handle wherein said fuel reservoir is configured to contain a combustible fuel, said fuel reservoir having an outlet;

a valve being positioned within said handle, said valve having an inlet and an exhaust, said inlet being fluidly coupled to said outlet of said fuel reservoir wherein said valve is configured to receive the combustible fuel from said fuel reservoir, said valve being adjustable between a minimum flow rate and a maximum flow rate wherein said valve is configured to release the combustible fuel between a minimum rate and a maximum rate; and a switch being slidably integrated into said handle, said switch being mechanically coupled to said valve, said switch actuating said valve between said minimum flow rate and said maximum flow rate wherein said switch is configured to adjust the release of the combustible fuel between the minimum rate and the maximum rate.

3. The assembly according to claim 2, further comprising a fuel conduit being positioned in said elongated tube, said fuel conduit extending between said exhaust of said valve and said distal end of said elongated tube, said fuel conduit being fluidly coupled to said exhaust of said valve wherein said fuel conduit is configured to direct the combustible fuel to said distal end of said elongated tube.

4. The assembly according to claim 1, further comprising:

an ignitor being integrated into said handle, said ignitor being in communication with said trigger, said ignitor being actuated when said trigger is depressed, said ignitor producing an electrical current when said ignitor is actuated; and a conductor being electrically coupled to said ignitor, said conductor extending to said distal end of said elongated tube, said conductor having a contact being electrically coupled to said conductor wherein said contact is configured to produce a spark when said ignitor is actuated, said contact being disposed in said distal end of said elongated tube wherein said contact is configured to ignite the combustible fuel.

5. The assembly according to claim 1, wherein said cutting unit comprises a button being movably integrated into said handle, said button being positioned proximate said well, said button being in mechanical communication with said cutter, said cutter being urged into said cutting position when said button is depressed.

6. A candle maintenance tool assembly for trimming a wick of a candle and lighting the wick of the candle, said assembly comprising:

a lighter having a handle and an elongated ignition tube extending away from said handle wherein said elongated ignition tube is configured to be extended into a candle, said elongated ignition tube producing a flame when said lighter is actuated wherein said lighter is configured to ignite a wick of candle, said handle having a front end and a back end, said handle being elongated between said front end and said back end, said handle having a trigger being movably integrated into said handle wherein said trigger is configured to be manipulated, said elongated ignition tube having a distal end with respect to said handle, said distal end being open, said back end of said handle having a well extending toward said front end wherein said back end is configured to insertably receive the wick of the candle;

a fuel reservoir being positioned within said handle wherein said fuel reservoir is configured to contain a combustible fuel, said fuel reservoir having an outlet;

a valve being positioned within said handle, said valve having an inlet and an exhaust, said inlet being fluidly coupled to said outlet of said fuel reservoir wherein said valve is configured to receive the combustible fuel from said fuel reservoir, said valve being adjustable between a minimum flow rate and a maximum flow rate wherein said valve is configured to release the combustible fuel between a minimum rate and a maximum rate;

a switch being slidably integrated into said handle, said switch being mechanically coupled to said valve, said switch actuating said valve between said minimum flow rate and said maximum flow rate wherein said switch is configured to adjust the release of the combustible fuel between the minimum rate and the maximum rate;

a fuel conduit being positioned in said elongated tube, said fuel conduit extending between said exhaust of said valve and said distal end of said elongated tube, said fuel conduit being fluidly coupled to said exhaust of said valve wherein said fuel conduit is configured to direct the combustible fuel to said distal end of said elongated tube;

an ignitor being integrated into said handle, said ignitor being in communication with said trigger, said ignitor being actuated when said trigger is depressed, said ignitor producing an electrical current when said ignitor is actuated;

a conductor being electrically coupled to said ignitor, said conductor extending to said distal end of said elongated tube, said conductor having a contact being electrically coupled to said conductor wherein said contact is configured to produce a spark when said ignitor is actuated, said contact being disposed in said distal end of said elongated tube wherein said contact is configured to ignite the combustible fuel; and a cutting unit being movably integrated into said handle, said cutting unit being actuatable into a cutting condition wherein said cutting unit is configured to cut the wick of the candle to a desired length, said cutting unit comprising:

a cutter being movably integrated into said handle said cutter being positioned within said well inset from said back end of said handle such that said cutter is configured for cutting the wick when the wick is positioned to extend within said well, said cutter extending through said well in said back end of said handle when said cutter is urged into a cutting position, said cutter being biased into a retracted position having said cutter being displaced from said well; and a button being movably integrated into said handle, said button being positioned proximate said well, said button being in mechanical communication with said cutter, said cutter being urged into said cutting position when said button is depressed.

* * * * *